US005120023A

United States Patent [19]

Kawabata

[11] Patent Number: 5,120,023

[45] Date of Patent: Jun. 9, 1992

[54] HOIST WINDING SYSTEM

[75] Inventor: Yoshihiko Kawabata, Tokyo, Japan

[73] Assignee: Kabushiki Kaisha Toshiba, Kanagawa, Japan

[21] Appl. No.: 730,389

[22] Filed: Jul. 15, 1991

Related U.S. Application Data

[63] Continuation of Ser. No. 313,554, Feb. 22, 1989, abandoned.

[30] Foreign Application Priority Data

Feb. 23, 1988 [JP] Japan ..... 63-40110

[51] Int. Cl.[5] ..... B66D 5/08; B66D 1/50

[52] U.S. Cl. ..... 254/275; 187/115

[58] Field of Search ..... 254/272, 273, 274, 275, 254/362, 378; 73/158; 187/115, 134, 136

[56] References Cited

U.S. PATENT DOCUMENTS

| | | | |
|---|---|---|---|
| Re. 10,585 | 4/1885 | Wheeler | 254/273 |
| 2,074,835 | 3/1937 | Fitz Gerald | 187/136 X |
| 3,098,992 | 7/1963 | Rath | 187/134 X |
| 3,507,360 | 4/1970 | Ostrander | 187/115 |
| 4,427,095 | 1/1984 | Payne | 187/134 |
| 4,739,969 | 4/1988 | Eckersley | 254/362 X |
| 4,756,188 | 7/1988 | Fennell | 254/272 X |

*Primary Examiner*—Katherine Matecki

*Attorney, Agent, or Firm*—Finnegan, Henderson, Farabow, Garrett and Dunner

[57] ABSTRACT

A shaft winding or winch system for raising and lowering a load attached to one end of a rope. The system includes a brake unit for braking a drum, a detection unit for detecting the length of the rope, and a control unit for controlling the brake unit according to the detected extended length of the rope and the torque generated by the drive unit.

12 Claims, 3 Drawing Sheets

HOIST WINDING SYSTEM

This application is a continuation of application Ser. No. 313,554, filed Feb. 22, 1989, now abandoned.

BACKGROUND OF THE INVENTION

This invention relates to a winch system, and more particularly to a winch system for use in a deep shaft.

FIG. 1 is a diagram showing a conventional winch system. A d.c. motor 10 drives a drum 12 that raises and lowers heavy loads packed in skips 16 and 18 attached to rope 14. A thyristor Leonardo device 20 controls d.c. motor 10, and a current detecting device 26 detects the armature current of d.c. motor 10. A current setting circuit 28 sets the electric current for motor 10 (connections not shown), and a current comparison circuit 30 compares the armature current detected by current detecting device 26 with the current set by current setting circuit 28. If the values of these two are equal, current comparison circuit 30 outputs a brake release command to brake release circuit 22 which controls the release of brake 24 on clamping drum 12.

In FIG. 1, a load is packed in skip 16, while skip 18 is unloaded. Then the loaded skip 16 is wound up, and a high output is required of d.c. motor 10. However, since the weight of the load of skip 16 is not known at the time that d.c. motor 10 starts up, the torque required to raise skip 16 is unknown. In the case of a machine moving a load horizontally, there is no particular problem if the motor only starts after the brake is released. However, in the case of a vertical winch system, if the winding operation is started only after brake 24 is first released, the armature current of d.c. motor 1 cannot generate a sufficient torque and skip 16 will begin to fall. The downward movement of skip 16 stops when the torque developed by motor 10 equals the downward torque exerted by the weight of skip 16 on drum 12 Subsequently, skip 16 only starts to be wound upwards when a net upwards torque is generated. This phenomenon is very dangerous; therefore, before releasing brake 24, a torque is generated by causing a constant armature current of a certain magnitude (for example, 200 percent of the rated magnitude) to flow in d.c. motor 10. In this way, the above-described phenomenon, called "fall-back," can be prevented from occuring.

Even though the weight of the load packed in skip 16 is not necessarily always the same, in the conventional system the torque that is generated by d.c. motor 10 prior to releasing brake 24 is always the same. This can result in several dangerous situations. If the load is heavier than normal, the starting torque will be insufficient, giving rise to the risk that the above described "fall-back" phenomenon will occur. On the other hand, if the load is lighter than normal, there will be an excess torque applied and the skip will start rapidly with a jerk. With the conventional system there is the problem that there will not be a smooth starting characteristic.

If the weight of the load, or total weight of skip 16 including the load, could be determined, there would be no problem In elevators etc., the weight of the cage is monitored using a load cell or the like. However, in the case of a winch system, it is much more difficult to adopt this technique than it is in the case of an elevator or the like. Specifically, in the case of a mining shaft, the vertical distance is long, often reaching about 2,000 m, so even if a weight detector could be fitted to the skip itself, the method of feeding electricity to it and handling the signal line would be a problem. Even if this problem could be solved, it would be necessary to allow for an electric cable of 2,000 m which must move up and down with the skip. This would be unsatisfactory because of the increase in the capacity of the shaft winding system which would be necessary.

SUMMARY OF THE INVENTION

It is an object of this invention to improve the starting characteristic of a shaft winding or winch system.

Another object of the invention is to make it possible to control the starting characteristic of a winch system in accordance with the torque needed to lift the skip.

The foregoing objects are achieved according to the present invention by providing a shaft winding or winch system for lowering and raising a load using a rope. The system comprises drive means for powering the operation of winding the load up, detection means for detecting the length of the rope, and control means for controlling brake means according to the detected length of the rope and the torque generated by the drive means.

According to another aspect of the present invention, the above objects are achieved by providing a method of winding a load attached to a rope up in a shaft. The method comprises the steps of winding the load up, braking the operation of winding the load up, detecting the length of the rope, and controlling the braking operation according to the detected length of the rope and the torque generated by the driving operation.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A more complete appreciation of the present invention and many of its attendant advantages will be readily obtained by reference to the following detailed description considered in connection with the accompanying drawings, in which.

DESCRIPTION OF THE PREFERRED EMBODIMENTS

First, the concept of this invention will be explained with reference to FIG. 2.

In order to obtain a smooth winding starting characteristic for a winch system, the torque that is generated by the d.c. motor before release of the brake should be equal to the sum of the torque required to overcome the frictional torque of the drum and the necessary torque to accelerate the load. Consequently, if the brake is released at a point when the torque generated by the d.c. motor equals the sum of these two torque values, a smooth start-up of the winding operation, without fall-back or jerking, is achieved. Furthermore, to find the frictional torque and the accelerational torque, the weight of the load must be known. The weight of the load can be determined by detecting the length that the rope is extended or stretched when the skip is loaded. However, since the rope extension cannot be directly measured, this must be done indirectly by measuring the distance from the bottom of the shaft to the skip bottom in the loaded and unloaded cases. It will be understood that other methods could be used to determine the length of the rope extension which would still be within the scope and intent of this invention.

Figure 2:
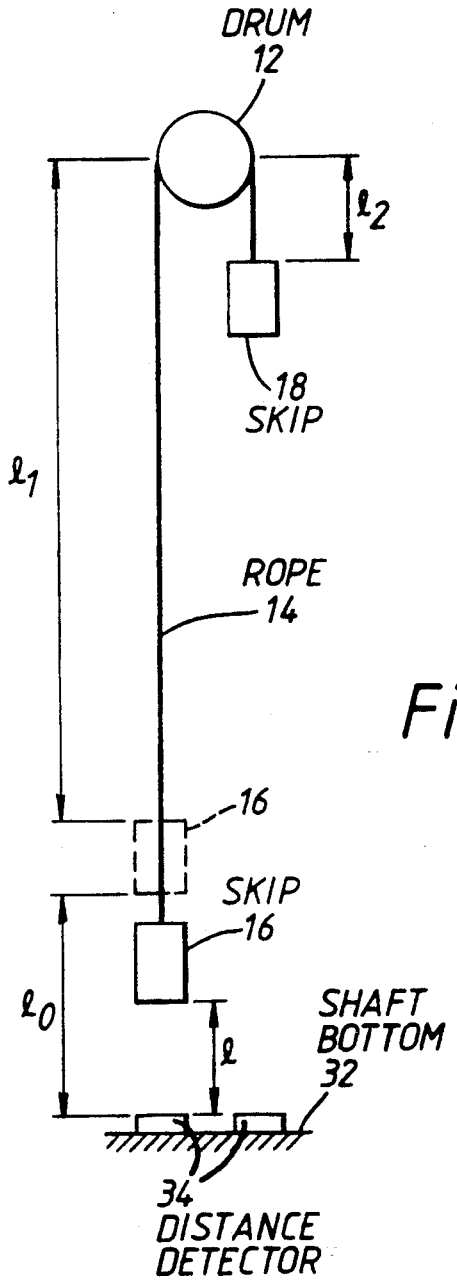
FIG. 2 is a diagram showing the concept of this invention.

Referring to FIG. 2, the broken line shows the position of skip 16 when it is unloaded and the solid line indicates its position when loaded. The weight W (ton) of the load is expressed by the following equation:

$$W=(l_0-l)/K \quad (1)$$

where $l_0$ is the distance (m) from the bottom of the shaft 32 to the skip 16, when unloaded. l is the distance (m) from the bottom of the shaft to skip 16 when the skip is loaded. K is the extension coefficient of rope 14 which is dependent upon the material of the rope.

Next, assuming that the frictional torque Tf (ton·m) is Kf percent of the total hanging weight, $$Tf=[2Wc+W+w(l_1+l_2)\times r\times Kf/100] \quad (2)$$

where Wc is the weight (ton) of the skip, w is the rope unit length weight (ton/m), $l_1$ is the rope length from drum 12 to skip 16; $l_2$ is the rope length (m) from drum 12 to skip 18, and r is the radius (m) of drum 12.

Acceleration torque Ta (ton/m) is expressed by the following equation:

$$Ta=(GDl^2+GD^2)n/375\times ta \quad (3)$$

where $GDl^2$ is the value of the total weight connected to inertial moment (ton-$m^2$), $GD^2$ is the inertial moment (ton-$m^2$) of all of the rotary bodies, such as the d.c. motor armature connecting shaft etc., n is the top rotational speed (rpm) of drum 12, and ta is the acceleration time (sec.) up to the top rotational speed of drum 12.

Inertial moment $GDl^2$ is found by the following equation:

$$GDl^2=365\times Wt\times V^2/n^2 \quad (4)$$

where the total weight Wt (ton) is:

$$Wt=2W_c+W+w(2l_1-l_2+2\ lo) \quad (5)$$

In above equations (1) to (5), there is only one variable, the remaining values all being known. Consequently, if we find the distance l from the shaft bottom 32 to skip 16 when the skip is loaded, we can find the torque which the d.c. motor should generate, i.e. the total of the frictional torque and the acceleration torque.

An embodiment of the invention based on the concept described above is described below with reference to the drawings.

Figure 1:
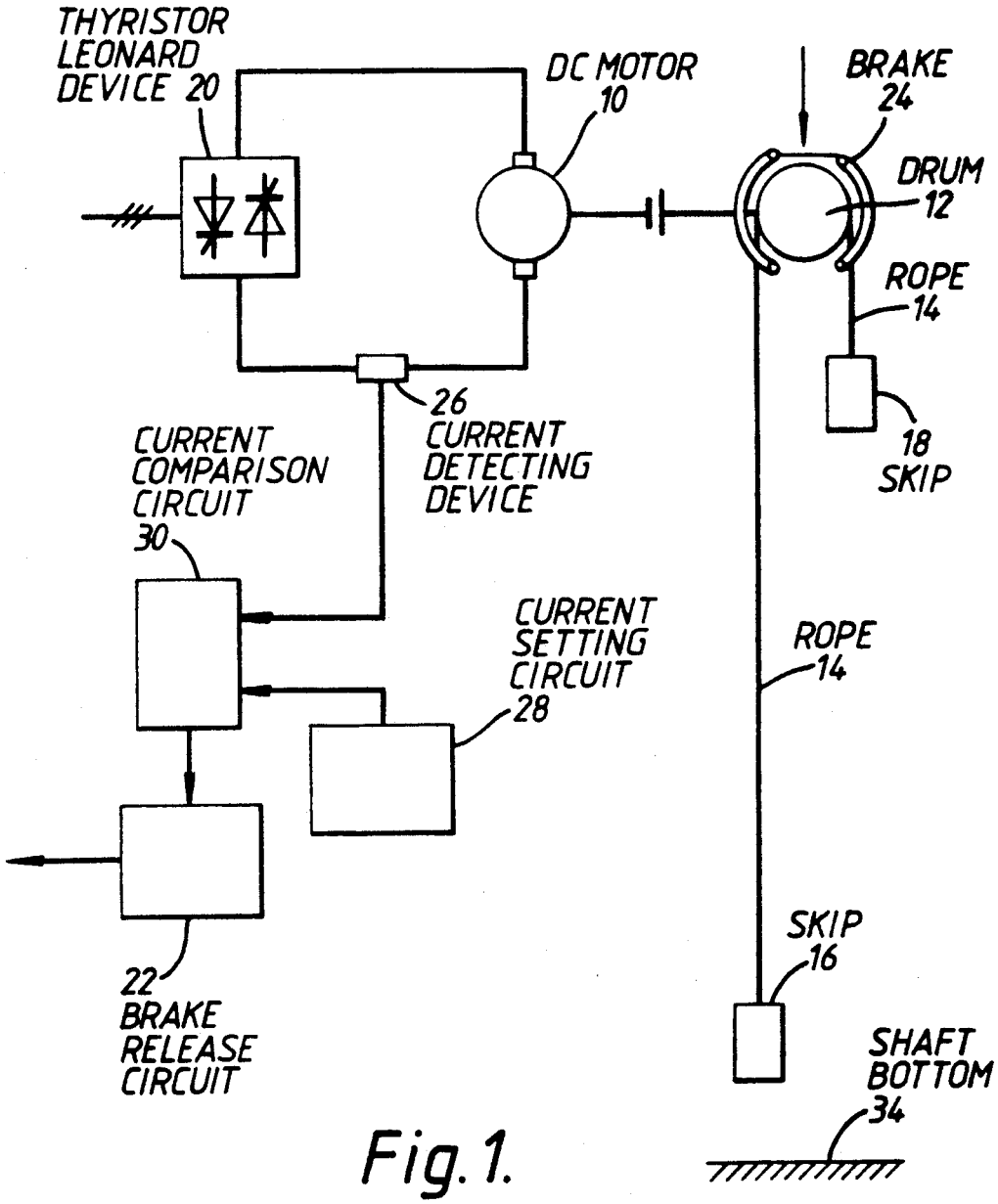
Fig. 1. PRIOR ART
FIG. 1 is a diagram showing a conventional winch winding system.
Figure 3:
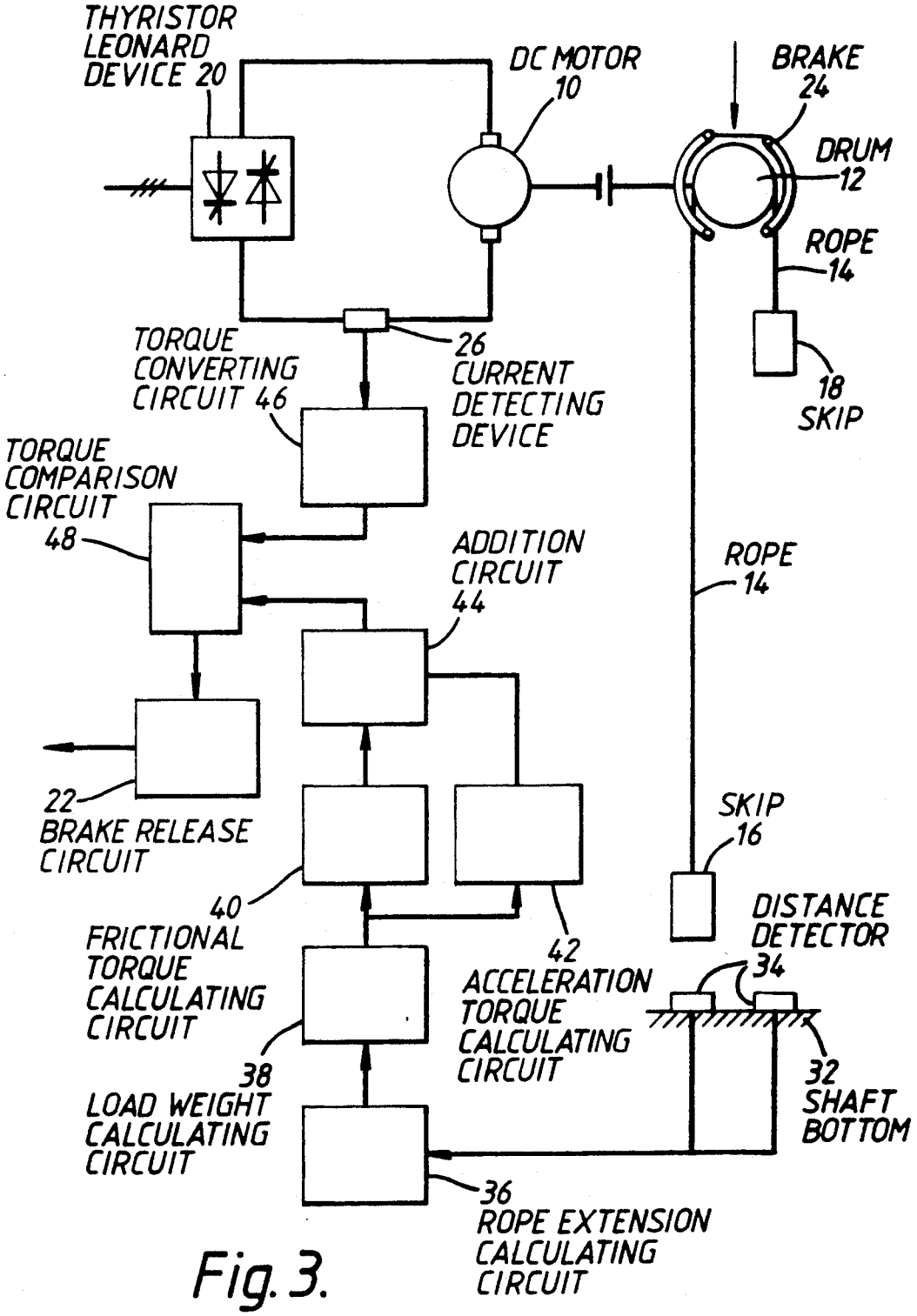
FIG. 3 is a diagram showing a winch system in accordance with a preferred embodiment of this invention.

FIG. 3 is an overall block diagram showing an embodiment of the winch system according to this invention. Parts which are the same as those in FIGS. 1 and 2 are given the same reference numerals. In FIG. 3, a d.c. electric motor 10 drives drum 12 that winds the load on skips 16 and 18 up or down by means of rope 14. A thyristor Leonardo device 20 controls d.c. electric motor 10. A current detecting device 26 detects the armature current of d.c. electric motor 10. A distance detector 34 detects the distance from the shaft bottom 32 to skip 16 when it is loaded. A rope extension calculating circuit 36 calculates the a distance $l_o-l$ based on the input from distance detector 34. A load weight calculating circuit 38 calculates the weight of the load from the extension of rope 14 found by rope extension calculating circuit 36 based on equation (1) above. A frictional torque calculating circuit 40 calculates the frictional torque of the shaft from the load weight found by load weight calculating circuit 38 based on equation (2) above. An acceleration torque calculating circuit 42 calculates the required acceleration torque from the load weight found by load weight calculating circuit 38 based on equation (3) above. An addition circuit 44 calculates the total of the frictional torque and the acceleration torque. A torque converting circuit 46 converts the armature current detected by current detecting device 26 into a torque. A torque comparison circuit 48 compares the total torque found by addition circuit 44 with the torque found by torque converting circuit 46. The torque generated by d.c. motor 10 increases and when these two are equal in value, torque comparison circuit 48 outputs a brake release command to brake release circuit 22 to release the brake on drum 12. The distance detector 34, for example, can be responsive to ultrasonic waves or be a photo sensor. It is well known how to use hard wired circuits or software to construct the calculation circuits to operate in accordance with the above equations.

As described above, with the shaft winding system of this invention, the following benefits are obtained:

(a) A smooth starting characteristic can always be obtained, so operation can be performed without fall-back or jerking.

(b) Since the load weight of the skip can be measured by a non-contacting system, without mounting a weight detector on the skip itself, this invention can be applied very easily to existing winch systems in shafts.

It should be noted that, in the above embodiment, the various calculations are performed by various calculating circuits, but it is also possible to perform these calculations by software using a computer or the like.

What is claimed is:

1. A winch system using a rope with a load attachably connected to one end for raising and lowering the load, comprising:

means for carrying the rope;

drive means for developing torque to drive the carrying means to raise and lower the load;

brake means for braking the carrying means for carrying said rope;

detection means for detecting a distance from a reference point to the load end of the rope; and control means for controlling the brake means according to the detected distance and the torque generated by the drive means.

2. The winch system of claim 1 wherein the means for carrying the rope comprises a drum.

3. The winch system of claim 1 wherein the drive means includes a motor and motor control means for controlling the operation of the motor.

4. The winch system of claim 3 wherein the control means includes a current detection means for detecting the current to said motor and generated torque calculation means for calculating the torque generated by the drive means based on the detected current to said motor.

5. The winch system of claim 1 wherein the detection means comprises a photo sensor located in the shaft.

6. The winch system of claim 1 wherein the detection means comprises an ultrasonic detector located in the shaft.

7. The winch system of claim 1, wherein the detection means detects the distance from the reference point to the load end of the tope both (a) at times when the load is not attached to the rope both (b) at times when the load is attached to the rope, and the control means includes rope extension calculating means for calculating a difference between the distance to the load end of the tope when the load is not attached to the rope and the distance to the load end of the rope when the load is attached to the rope.

8. The winch system of claim 7, wherein the control means further includes load weight calculating means for calculating a load weight based on the difference calculated by the rope extension calculating means.

9. The system of claim 8, wherein the control means includes torque calculation means for calculating necessary torque to raise the load based on the load weight calculated by the load weight calculating means, and comparator means for comparing the necessary torque with the torque generated by the drive means and for controlling the brake means to release the brake on said drum means when the necessary torque equals the generated torque.

10. The winch system of claim 9 wherein the torque calculation means includes frictional torque calculating means for calculating a frictional torque of the winding system based on the equation $W=(l_0-l)/k$ where $l_0$ is the distance from the reference point to the load end of the rope when the load is not attached to the rope, l is the distance from the reference point to the load end of the rope when the load is attached to the rope, acceleration torque calculating means for calculating an acceleration torque of the winding system based on the equation $T_J=(GDl^2+GD^2)m/375\times ta$ where $GDl^2$ is the value of the total weight connected to the inertial moment, $GD^2$ is the inertial moment of all the rotary bodies, n is the top rotational speed of the drum, and ta is the acceleration time up to the top rotational speed of the drum, and adding means for calculating the total of the frictional torque and the acceleration torque.

11. A method of raising and lowering a load attachably connected to a rope which is frictionally carried on a drum, comprising the steps of driving the drum to raise the load;

braking the drum;

detecting the extended length of the rope when a load is attached; and controlling the braking of the drum according to the detected extended length of the rope and the torque generated by the driving operation.

12. The method of claim 11 wherein the step of controlling includes the step of calculating necessary torque to raise the load based on the detected extended length of the rope, the step of comparing the necessary torque with the torque generated by the drive operation, and the step of controlling the braking operation to release the brake on the drum when the necessary torque equals the generated torque.

* * * * *

UNITED STATES PATENT AND TRADEMARK OFFICE

CERTIFICATE OF CORRECTION

PATENT NO. : 5,120,023

DATED : June 09, 1992

INVENTOR(S) : Yoshihiko Kawabata

It is certified that error appears in the above-identified patent and that said Letters Patent is hereby corrected as shown below:

Claim 7, column 5, line 8, change "tope" to --rope--.

Claim 7, column 5, line 9, change "both" to --and--.

Claim 7, column 5, line 13, change "tope" to --rope--.

Claim 11, column 6, line 16, change "of" to --of:--.

Signed and Sealed this

Fifth Day of October, 1993

*Attest:*

*Attesting Officer*

BRUCE LEHMAN

*Commissioner of Patents and Trademarks*